US011001790B2

(12) United States Patent
Moorfield et al.

(10) Patent No.: US 11,001,790 B2
(45) Date of Patent: May 11, 2021

(54) METHODS AND COMPOSITIONS

(71) Applicant: Conopco, Inc., Englewood Cliffs, NJ (US)

(72) Inventors: David Moorfield, Merseyside (GB); Alyn James Parry, Merseyside (GB)

(73) Assignee: Conopco, Inc., Englewood Cliffs, NJ (US)

( * ) Notice: Subject to any disclaimer, the term of this patent is extended or adjusted under 35 U.S.C. 154(b) by 47 days.

(21) Appl. No.: 16/309,313

(22) PCT Filed: Jun. 6, 2017

(86) PCT No.: PCT/EP2017/063660
§ 371 (c)(1),
(2) Date: Dec. 12, 2018

(87) PCT Pub. No.: WO2017/215978
PCT Pub. Date: Dec. 21, 2017

(65) Prior Publication Data

US 2019/0264147 A1 Aug. 29, 2019

(30) Foreign Application Priority Data

Jun. 16, 2016 (EP) ..... 16174853

(51) Int. Cl.

| | |
|---|---|
| ***C11D 11/00*** | (2006.01) |
| ***C11D 1/94*** | (2006.01) |
| ***C11D 1/14*** | (2006.01) |
| ***C11D 1/24*** | (2006.01) |
| ***C11D 1/90*** | (2006.01) |

(52) U.S. Cl.
CPC ..... *C11D 11/0017* (2013.01); *C11D 1/94* (2013.01); *C11D 11/0064* (2013.01); *C11D 1/146* (2013.01); *C11D 1/24* (2013.01); *C11D 1/90* (2013.01)

(58) Field of Classification Search
CPC ... C11D 11/0017; C11D 11/0064; C11D 1/94; C11D 1/90; C11D 1/24; C11D 1/146
See application file for complete search history.

(56) References Cited

U.S. PATENT DOCUMENTS

| | | | | |
|---|---|---|---|---|
| 4,489,574 | A | 12/1984 | Spendel | |
| 4,784,666 | A | 11/1988 | Brenner et al. | |
| 4,793,943 | A * | 12/1988 | Haslop | C11D 3/14 510/303 |
| 2007/0128144 | A1 | 6/2007 | Bonastre Gilabert et al. | |
| 2009/0324653 | A1 | 12/2009 | Polonka et al. | |
| 2011/0252576 | A1* | 10/2011 | Boutique | C11D 1/83 8/137 |
| 2012/0208739 | A1* | 8/2012 | Dykstra | C11D 3/33 510/426 |
| 2012/0324653 | A1 | 12/2012 | Chawla | |
| 2014/0148374 | A1* | 5/2014 | Man | A61K 8/84 510/475 |
| 2014/0259448 | A1* | 9/2014 | Alexander | D06F 39/022 8/137 |

FOREIGN PATENT DOCUMENTS

| | | | | |
|---|---|---|---|---|
| CN | 1252093 | | 4/2006 | |
| CN | 1813048 | | 8/2006 | |
| CN | 101160387 | | 4/2008 | |
| CN | 102414305 | | 4/2012 | |
| CN | 105602748 | | 5/2016 | |
| EP | 1776945 | | 4/2007 | |
| EP | 2982735 | | 2/2016 | |
| WO | WO9833879 | | 8/1998 | |
| WO | WO2008074667 | | 6/2008 | |
| WO | WO2009040175 | | 4/2009 | |
| WO | WO2014056906 | | 4/2014 | |
| WO | WO2014087011 | | 6/2014 | |
| WO | WO2015/040444 | * | 3/2015 | C11D 3/382 |
| WO | WO2015193203 | | 12/2015 | |
| WO | WO2016022780 | | 2/2016 | |
| WO | WO17215979 | | 12/2017 | |

OTHER PUBLICATIONS

Search Report and Written Opinion in PCTEP2017063660; dated Aug. 31, 2017.
Search Report and Written Opinion in PCTEP2017063669; dated Aug. 17, 2017.
IPRP in PCTEP2017063669; dated May 2, 2018.

* cited by examiner

*Primary Examiner* — Amina S Khan
(74) *Attorney, Agent, or Firm* — Greenberg Traurig, LLP

(57) ABSTRACT

A method of laundering articles, the method comprising combining a detergent composition and water to provide a detergent solution, wherein the detergent composition comprises a surfactant system containing a betaine, then introducing into a washing machine basket the detergent solution so as to dampen articles in the basket; and then waiting for a duration of time during which no water or further detergent solution is added to the basket containing the dampened articles.

7 Claims, 1 Drawing Sheet

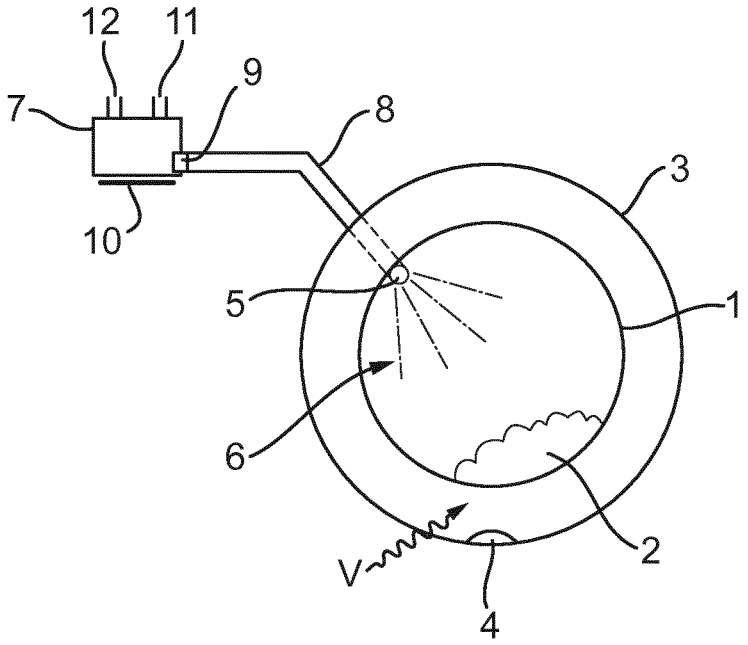
12
11
9
7
8
3
10
5
1
6
2
V
4

METHODS AND COMPOSITIONS

RELATED APPLICATIONS

The present application is a national phase filing under 35 USC 371 of International Application No. PCT/EP2017/063660, filed on Jun. 6, 2017, which claims the priority of European Patent Application No. 16174853.8, filed on Jun. 16, 2016, the entire contents of which are hereby incorporated by reference.

The invention relates to methods of laundering articles comprising a step of introducing laundry detergent to dampen articles in a washing machine basket, and to use of certain compositions in such methods.

BACKGROUND

In the developed world, and increasingly in the developing world, laundry is achieved using a washing machine. Broadly, washing machines can be divided into two classes: horizontal axis washing machines, in which the drum rotates about a horizontal axis, and vertical axis washing machines, in which the drum rotates about a vertical axis. Mostly commonly, horizontal axis washing machines are front loading, while vertical axis machines are top loading, although hybrid top loading machines having a horizontal axis are known.

Traditionally, heavily stained garments are pre-soaked prior to loading into the washing machine, usually in a solution of detergent and/or other stain remover ("product"). However, this is time consuming and laborious, and often messy as dripping articles are transferred from sink or tub into the washing machine.

Some modern machines include programs having a "prewash" function. The prewash is typically a shorted wash cycle in which product is used. A prewash may be consider a pre-soaking of articles in the washing machine prior to the main wash cycle. Such prewashes increase program duration and energy and water consumption.

For tough stain removal, consumers are often sceptical of the cleaning results they can achieve in a washing machine, even with a conventional prewash cycle. This is particularly true of vertical axis washing machines.

As a consequence, consumers will often directly apply product to stains. Sometimes, this is neat laundry detergent, although specially designed direct application products, for example, stain removal sprays, are available. This direct application is usually perceived to be the most effective pre-treatment for stubborn stain removal.

However, in a wash load of heavily-stained articles this direct application can be an inconvenient and time-consuming process. It can also be expensive as significant amounts of product will be used. Furthermore, it can often be wasteful and/or lead to increased detergent loads, leading to too much foaming during the subsequent wash cycle. In turn, greater amounts of product will often be used as consumers "double dose" (i.e. pre-apply and use a normal recommended amount for the wash).

Furthermore, all of these "before machine wash" application methods increase consumer exposure to products (for example, carrying articles between the sink and machine, or spraying a solution from a bottle).

SUMMARY

The invention is a result of the inventors' insight that there is an unmet need to provide a pre-treatment step that can be performed in a washing machine (prior to the main wash cycle) that more closely mimics the results of direct product application to stains.

The inventors have addressed this problem by providing a power treatment, as described here.

Importantly, the volume of detergent solution used in the power treatment is sufficient to dampen the articles, but the cycle does not include soaking the articles. In other words, during the power treatment there is no or substantially no free solution in the drum: all or substantially all of the solution is absorbed by the articles. As a consequence, only very small volumes of solution are used, maximising efficacy.

Advantageously, this means that high temperature power treatments can be used without large energy consumption, because the amount of liquid being heated is small. This in turn allows access to the benefits of high temperature stain removal without compromising energy efficiency.

The present invention relates to compositions that the inventors have found to be particularly suited to use in the power treatment. Accordingly, in a first aspect, the invention relates to a method of laundering articles using a detergent composition comprising a betaine co-surfactant to provide a power treatment. The inclusion of a co-surfactant as described herein has been shown to improve results obtained for the power treatment. This co-surfactant may be referred to herein as a coactive.

Without wishing to be bound to any particular theory, the inventors speculate the co-surfactant improves interfacial packing through modification of the packing parameter in the comparatively high concentration liquor used in the power treatment step.

Accordingly, in a first aspect the invention may provide a method of laundering articles, the method comprising:

(i) combining a detergent composition and water to provide a detergent solution, wherein the detergent composition comprises a surfactant system containing a betaine, then (ii) introducing into a washing machine basket the detergent solution so as to dampen articles in the basket; and then (iii) waiting for a duration of time during which no water or further detergent solution is added to the basket containing the dampened articles.

Suitably, the detergent used in the power treatment is used as the sole detergent in the subsequent wash cycle. It will be appreciated that this provides cost and environmental benefits. However, additional detergent may be added during the subsequent wash cycle. It will be appreciated that, whether or not additional detergent is added in the subsequent wash cycle, other products, for example, fabric softeners may be added.

Suitably, the coactive is a carboxylate betaine or sulfobetaine.

A particularly preferred coactive is cocamidopropyl betaine, also referred to as CAP-B.

Accordingly, in a second aspect, the invention may provide use of CAP-B in a method of laundering articles, the method comprising:

(i) combining a detergent composition and water to provide a detergent solution, then (ii) introducing into a washing machine basket the detergent solution so as to dampen articles in the basket; and then (iii) waiting for a duration of time during which no water or further detergent solution is added to the basket containing the dampened articles.

Suitably at step (iii) the duration of time is at least 5 minutes.

Options and preferences described for the first aspect similarly apply to the second and third aspects, and vice versa.

In a third aspect, the invention relates to a detergent composition a surfactant system containing a betaine, which may account for about 10 wt % to about 25 wt % of the surfactant content of the composition, for example about 20 wt %.

In a third aspect, the invention may provide a detergent composition comprising a surfactant system containing CAP-B, optionally wherein the CAP-B accounts for about 10 wt % to about 25 wt % of the surfactant content of the composition.

Preferably, CAP-B accounts for about 20 wt % of the surfactant content of the composition.

In one embodiment, the surfactant content of the composition is about 20 wt % betaine and the remainder of the surfactant content is about 7:3 LAS:AES.

Step (i)

Combining detergent and water will lead to dissolution. Preferably the dissolution is complete (i.e. the solution is homogeneous).

Suitably, the detergent and water are combined in a chamber in the washing machine. It will be appreciated that the method may also include placing articles to be laundered into the washing machine basket. By providing a chamber in which the detergent solution is pre-combined, usually pre-dissolved, the homogeneity of the detergent solution is improved, which is important at the high concentrations made possible by the invention. Preferably, the detergent is a liquid detergent product. Use of a liquid detergent improves homogeneity and avoids the presence of particulates and sediment formation, which may clog the pipe connecting the chamber to the basket interior and/or the nozzle used for spraying. Of course, use of a detergent product in powder form is also envisaged.

The inventors have found that improved stain removal for certain classes of stain is achieved when the detergent solution is heated. Owing to the small volumes of detergent solution used, only relatively small amounts of energy are needed to heat the detergent solution. As a result, benefits associated with higher temperature washes can be accessed without seriously impacting the environmental performance of the washing machine.

Accordingly, the method may comprise providing a heated detergent solution. For example, step (i) may comprise combining detergent and heated water to provide a detergent solution (for example, at a temperature as described above). Step (i) may comprise combining detergent and water to provide a detergent solution and heating said solution.

In some embodiments, the temperature of the detergent solution during spraying is greater than 25° C., preferably greater the 30° C., more preferably greater than 35° C. For example, the temperature may be around 40° C. In some embodiments, the temperature is preferably greater than 45° C., more preferably greater than 50° C., more preferably greater than 55° C. For example, the temperature may be around 60° C. Of course, higher temperatures are also envisaged.

It will be appreciated that the temperature during spraying may be higher, such that the temperature of the solution contacting the articles is greater than 25° C., preferably greater the 30° C., more preferably greater than 35° C. For example, the temperature of the solution contacting the articles may be around 40° C. In some embodiments, the temperature is preferably greater than 45° C., more preferably greater than 50° C., more preferably greater than 55° C. For example, the temperature of the solution contacting the articles may be around 60° C.

It will be appreciated that the washing machine may provide a means for selecting a preferred temperature. In other words, more than one power treatment program may be provided by a machine, each power treatment program having a different detergent solution temperature.

Step (ii)

In step (ii), detergent solution is introduced directly into the basket, where it is adsorbed onto and absorbed into the fabric of the articles so as to dampen them. Suitably, it is sprayed, although other introduction methods may be envisaged. The introduction method suitably ensures that the detergent solution is applied to the articles so as to ensure good coverage, thereby dampening them. Accordingly, suitably the detergent solution is introduced into the basket as dispersed droplets. Suitably, the washing machine comprises one or more delivery means configured to generate droplets as the detergent solution enters the basket from the chamber. These will typically be nozzles.

It is not intended that the amount of detergent solution sprayed is sufficient to saturate the articles such that there is free solution. Consequently, there is minimal loss of detergent solution from the basket to the outer drum (the washing machine basket is located in a drum, as is conventional. The volume of the drum surround the exterior of the basket may be referred to as the "outer drum").

Suitably, less than 25% by volume of the detergent solution is lost to the outer drum, preferably less than 20%, more preferably less than 15%, more preferably less than 10%, mostly preferably less than 5%.

As explained above, the volume of detergent solution used is relatively small. Suitably, the volume of detergent solution is less than 5% of the total drum volume, preferably less than 3%, more preferably less than 1%. For example, it may be less than 0.9% of the total drum volume, less than 0.8%, less than 0.7%, less than 0.6% or even less than 0.5%. As high concentrations are observed to typically improve performance, preferably the volume of detergent solution is less than 0.5% of the total drum volume.

Accordingly, in some embodiments, the volume of the chamber is less than 5% of the total drum volume, preferably less than 3%, more preferably less than 1%. For example, it may be less than 0.9% of the total drum volume, less than 0.8%, less than 0.7%, less than 0.6% or even less than 0.5%. It will be appreciated that some headspace in the chamber may be desirable during step (i). Accordingly, the volume of the chamber may be less than 7.5% of the total volume of the drum, for example less than 4.5%, less than 1.5%, less than 1%, less than 0.8%, less than 0.6%.

For example, for a domestic washing machine, preferably the amount of detergent solution is 1 l or less, for example 900 ml or less, 800 ml or less, 700 ml or less, 600 ml or less, or 500 ml or less. Smaller volumes are preferred as these permit high concentrations of detergent and reduce the energy needed to heat the solution if applicable.

It will be understood that the optimum volume of detergent solution will depend on the type and/or quantity of articles to be laundered. The articles may be characterised by their "dry" (i.e. pre-power treatment) weight in kilograms.

Although domestic machines often have rated capacities of around 7 kg of dry weight articles, in practice it is often difficult to load the machines with that amount of material.

As a result, the dry weight of a conventional load is likely to be less, around a few kilograms.

Suitably, the volume of detergent solution is 750 ml or less per kg of articles to be laundered, for example 700 ml or less, for example 600 ml or less, for example 550 ml or less, for example 500 ml or less, for example 450 ml or less, for example 400 ml or less, for example 350 ml or less, for example 300 ml or less, for example 250 ml or less, for example 200 ml or less. In some embodiments, the volume of detergent solution is 150 ml or less per kg of articles to be laundered, for example 140 ml or less, for example 130 ml or less, for example 120 ml or less, for example 110 ml or less, for example 100 ml or less, for example 50 ml or less.

For most fabrics, a volume of 150 ml or less per kg, preferably 100 ml or less per kg, provides good results.

In many cases, the amount of detergent used and volume of water used will be fixed for consumer ease, regardless of the weight of the laundry load.

However, adjusting the amount of detergent and/or volume of water used to make the detergent solution in step (i) increases efficiency and economy and reduces waste.

Accordingly, in some embodiments the method includes a pre-step of weighing the articles and determining, based on said weight, the amount of water to be added to the chamber in step (i). Naturally, if a fixed amount of detergent product is added by, for example, the user, then the concentration of the detergent solution will vary. This weighing and determination may be carried out by the washing, based on pre-programmed values.

It may also be desirable to adjust the amount of detergent product used. Accordingly, in some embodiments the method includes a pre-step of weighing the articles present in the basket and determining, based on said weight, the amount of detergent product to be added to the chamber in step (i). This weighing and determination may be carried out by the washing, based on pre-programmed values. Suitably, in these embodiments, the washing machine is provided with a reservoir for housing detergent product, the reservoir being in fluid communication with the chamber, with a valve provided between the reservoir and the chamber that is configured to meter amounts of detergent product.

As has been explained herein, an advantage of the relatively very small water volumes is that high concentration detergent solutions can be used in the power treatment The inventors have found that certain detergent solution concentrations show especially advantageous effects. Different optimum concentrations may be used for different stain types.

Suitably, the dilution factor is 40 parts water to 1 part detergent product (dilution factor=40), or less. Or less in this context means 40 parts water or fewer to 1 part detergent product. Preferably, the dilution factor is 35 or less, preferably 30 or less. In some embodiments, the dilution factor is 25 or less, for example, 20 or less. The inventors have determined that for many applications, a dilution factor of around 15 provides a good balance between performance and economy. Accordingly, in some embodiments, the dilution factor of the detergent solution is about 15.

For some stains, and indeed for some wash programs and machines, higher concentrations may be preferable. Accordingly, in some embodiments, the dilution factor may be as low as 10 or less, for example, 9 or less, 7 or less, 5 or less, or even around 2.

For example, the dilution factor may be 5 to 40, preferably 5 to 20. In some embodiments, the dilution factor is 5 to 15, or even as low as 5 to 10. In some embodiments, the dilution factor is 2 to 10, for example 2 to 7, for example 2 to 5.

Suitably, the amount of surfactant in the detergent solution used in the power treatment is at least 5,000 ppm, preferably at least 6,000 ppm, for example at least 7,000 ppm. Even higher surfactant amounts may be preferred, for example at least 10,000 ppm, for example at least 12,000 ppm. In some embodiments, the amount of surfactant is at least 15,000 ppm, for example as high as 20,000 ppm, 30,000 ppm, 40,000 ppm or even as high as 50,000 ppm.

It will be appreciated that these surfactant values are significantly higher than those used in normal wash cycles (which typically have surfactant values in the regions of several hundred ppm). The values are also higher than conventional pre-wash cycles and "soak" processes (where the articles are first soaked in a sink or similar).

During step (ii), while the detergent solution is being introduced (for example, sprayed), the drum may undergo rotation and/or reciprocation to facilitate effective dampening of the articles and to assist an even coverage of the detergent solution across all of the articles. A vertical axis machine may additionally or alternatively undergo a shaking (side-to-side and/or up-and-down) motion. Additionally or alternatively, in the case of vertical machine having an agitator the agitator may rotate and/or reciprocate. In other words, it is preferable that, during spraying, the articles are continuously redistributed, for example, by "tumbling", in the drum so as to improve detergent solution coverage.

Step (iii)

Step (ii) is followed by a holding step (step iii). Suitably, the holding step is more than a few minutes' duration, for example, the holding step duration may be at least two minutes, for example, at least 5 minutes, for example at least 10 minutes or at least 15 minutes. For example, the holding step duration may be 5 minutes to 30 minutes, for example 10 to 20 minutes.

The inventors have observed that enhanced stain reduction is achieved when the drum is held steady (i.e. without movement) during the holding step (step iii), as compared to a comparable washing machine program without a power treatment as claimed. If an agitator is present, it is not necessary that the agitator move during step (iii). Accordingly, step (iii) may be a holding period in which no water or further detergent solution is added to the basket and wherein the basket remains stationary.

However, preferably some agitation is provided during step (iii). Accordingly, in some preferred embodiments, step (iii) comprises a holding period in which no water or further detergent solution is added to the basket and wherein the basket is agitated. Suitably, the basket is agitated for a period of at least 5 mins. In some embodiments, the basket is agitated for a period of at least 10 mins.

This improves stain removal and cleaning performance, as described herein. This is thought to be because the agitation causes the articles to rub against each other, the basket and, if present, the agitator, working the detergent into the fibres of the articles and lifting stains.

In the case of horizontal axis machine, suitably the agitation is provided by the drum rotating and/or reciprocating during the holding step (step iii).

In some embodiments, the drum rotates at a rate of 10 to 150 rpm, for example, 10 to 100 rpm. Naturally, the drum rotation speed may depend on the size and type of machine. In some embodiments, the rotation speed is 15 to 90 rpm, preferably 30 to 50 rpm. It will be appreciated that the rotation speed may remain essentially constant during the power treatment, or may vary. For example, an on-offreverse-off rotation pattern may be used. For example, the inventors have demonstrated enhanced effects for a power treatment having a 28 s-2 s-28 s-2 s pattern at 45 rpm.

The inclusion of a power treatment of the invention in a wash cycle has been shown to improve cleaning performance and tough stain removal. Typically, the power treatment is provided as part of a wash program, and is followed by a wash cycle.

It will be appreciated that the power treatment may be directly followed by a rinse phase and optionally a spin cycle.

Optional Step (iv)

Suitably, steps (i)-(iii) described above are followed by a washing step (iv), the step comprising adding water and optionally detergent to the drum and agitating the articles. Preferably, no detergent (i.e. only water is added) during the washing step. Preferably, nothing other than water is added during the washing. Suitable volumes and temperatures are described above.

Suitably, volume of water added in the washing step is at least 5% of the total volume of the drum. The precise amount will depend on the machine and program settings, and may be at least 10%, at least 20%, or even more. For example, a top loading automatic machine may almost completely fill the drum with water.

Advantageously, shorter washing steps may be used owing to the stain removal and cleaning facilitated by the power treatment than would normally be used. For example, the washing cycle may be so-called half wash.

Advantageously, cooler washing steps may be used owing to the stain removal and cleaning facilitated by the power treatment. For example, even for tough staining, the washing step temperature may be 40° C. or less, 35° C. or less, 30° C. or less, 25° C. or less. In some preferred embodiments, no heating is used (unheated water is added): the washing step temperature is the temperature of the cold fill. Naturally, this will vary with supply and geographical variation, but may be as low as 10° C., or even lower. For example, in northern US states the water supply may be as low as 7° C. or even 5° C. in winter. This may be referred to as an ambient wash.

It will be appreciated that the power treatments of the present invention use high concentrations of detergent. Lower concentrations are used in washing steps. In preferred embodiments, no additional detergent is added in the washing step. In other words, only water is added. The detergent sorbed onto and into the articles following the power treatment is the only detergent present in the washing step.

This means that only one product is used, and only one product must be added to the machine. This reduces waste, improves economy, and enhances convenience for the consumer.

It will be appreciated that the washing step may be directly followed by a rinse phase and optionally a spin cycle.

The methods may be carried out in a horizontal axis machine or a vertical axis machine.

BRIEF DESCRIPTION OF THE DRAWINGS

FIG. 1 is a schematic view of a washing machine configuration according to the disclosure.

DETAILED DESCRIPTION

The invention will be described with reference to FIG. 1, which shows schematically one how the basket, drum and chamber of a washing machine can be configured to carry out the method of the invention. It will appreciated that this is provided by way of illustration and not by way of limitation. A horizontal axis machine is shown. Naturally, the methods of the invention may also use vertical axis machines.

The washing machine has a basket 1. Prior to washing, articles 2 are placed in this basket. For ease of illustration, a small volume of articles is shown. In a usual wash load, the volume within the basket may be much greater. The basket 1 is housed within a drum 3. There is a void between the basket and outer circumference of the drum. This is labelled "V". The void V is often referred to as the "outer drum". Conventional horizontal axis washing machines have this arrangement. During a normal wash cycle, the wash liquors are present not only in the drum, but also at the bottom of this void. Therefore, during a normal fill from the bottom of the drum upwards, a significant volume of wash liquor enters the drum before beginning to wet the cloths. The basket 1 has holes in its wall, so that excess liquid passes through the wall into the outer drum, for example, during spinning. In vertical axis machines, the void surrounds the basket circumference in the horizontal plane.

During spinning, the drum may be drained, for example, through opening a drain 4. Excess liquid is released from the clothes owing to centrifugal forces. Often, very high rotation speeds are used to remove water, for example 1,000-1,600 rpm.

The machines of the invention have an introducing means 5 for introducing the detergent solution 6 into the basket. As described above, the detergent solution is introduced as a spray or mist, so the introducing means is suitably a nozzle. As is evident from the FIGURE and discussion herein, the detergent solution is applied to the articles without the need to first fill the bottom of the void of the drum.

The detergent solution is prepared in a chamber 7. The chamber is fluidically connected to the introducing mean 5 by a tube 8. As can be seen from the FIGURE, the detergent solution prepared in the chamber passes to the introducing means 5 without first contacting the articles.

In other words, the detergent solution is typically sprayed onto dry articles. A value 9 may be provided to control flow from the chamber to the basket. In some embodiments, the detergent solution is heated. Accordingly, the chamber 7 may comprise or be in thermal contact with a heating means 10. Alternatively or additionally, tube 8 may comprise a heating means such as an in-flow heater.

Chamber 7 comprises an inlet for water 11. Via this inlet, water is introduced to make the detergent solution. Detergent product may be added via an inlet 12. This may simply be to top of a detergent drawer, into which the user pours detergent, or may fluidically link to such a drawer or other detergent reservoir. Inlet 11 and/or inlet 12 may comprise metering means (not shown) to control the amount of detergent and/or water added. This may be determined by the machine performing a weighing step, as described herein.

Definitions

Articles

As used herein, this term refers to fabric items that are laundered, for example, in the machines and methods described herein. Articles may be clothing, bedding, curtains, or any other fabric items.

Dampen

In the power treatment step, the articles are dampened. As used herein, this term means that detergent solution is contacted with the articles so as to adsorp onto the surface of the articles and to at absorb into the fibres of the articles. Individual articles, or indeed portions of articles, may be saturated, but the amount of solution during the power treatment step is not intended to soak the articles in the conventional sense. In other words, it is not intended that there is a significant volume of free solution in the basket. As a result, comparatively little, if any, solution will be lost to the outer drum during the power treatment, even if the drum is rotated to provide agitation.

Detergent

Detergent and detergent product as used herein refer to a laundry formulation comprising a detergent. Suitable detergent products are known in the art. Typically, they contain surfactants and builders. They may or may not contain enzymes. Other ingredients may include alkalis, antiredeposition agents, bleaches, anti-microbial agents, fabric softeners, fragrances, optical brighteners, preservatives, hydrotopes (in the case of liquid products), processing aids, foam boosters and regulators. The detergent products may be powders or liquids.

The detergent product comprises a surfactant system. Suitably, the term surfactant system refers to all of the surfactant present in the detergent product.

The surfactant system may account for 0.5-50 wt % of the detergent product. Preferably, the surfactant system accounts for 0.5-25 wt % of the detergent product, for example 1-15 wt. In some cases, the amount is 8-12 wt %, such as around 10 wt %.

The surfactant system comprises a coactive and one or more surfactants. It will be appreciated that the coactive is also a surfactant.

A preferred coactive is cocamidopropyl betaine (CAP-B). CAP-B is derived from coconut oil and dimethylaminopropylamine. It may be provided as a viscous pale yellow solution.

Suitably, the coactive accounts for at least 5 wt % of the surfactant system, preferably at least 10 wt %, more preferably at least 15 wt %. In a preferred embodiment, the coactive accounts for around 20% of the surfactant system.

In other words, the detergent product may comprise 2 wt % coactive and 8 wt % other surfactants.

Preferably, the other surfactants comprise linear alkylbenzenesulfonates (LAS) and alkyl ether sulfates (AES). In a preferred embodiment, the surfactant system comprises coactive and LAS and AES in a ratio of from 2:8 to about 8:2 LAS:AES. A suitable AES is sodium lauryl ether sulfate (SLES). In some embodiments, no further surfactants are present in the surfactant system. In other embodiments, non-ionic surfactants may also be present.

In some embodiments, the detergent product contains a builder. In some embodiments, the detergent product contains an enzyme.

Detergent Solution

Detergent solution, as used herein, refers to the liquid applied to the articles in the power treatment step. The detergent solution is obtained by mixing detergent product with water in the chamber. Preferably, the mixture is homogeneous, although it will be appreciated that some detergent products may not completely dissolve, leading to some turbidity in the detergent solution.

Direct Application

This refers to application of a product by a consumer, usually in neat (i.e. not diluted) form, to a stain prior to washing. The direct application may use a product designed for such purposes (for example, a stain removal spray), or may use a liquid detergent designed for use in a machine laundry cycle. Direction application may be abbreviated herein to DA.

Dilution Factor

This refers to parts (by volume) of water to parts (by volume) product. For example, a dilution factor of 10 refers to 1 part product to 10 parts water (for example, 10 mL liquid product and 100 mL, 1 part powder detergent to 10 part water).

Wash Program

A washing machine typically has one or more programs which the user selects to suit the articles to be laundered and the degree of soiling. Each program is a sequence of stages with varied conditions (duration, water/solution volume, speed, temperature). As used herein, the word cycle refers to an individual stage and the word program means a combination of those stages.

Wash Cycle

Also called a washing step, this is a wash cycle in which articles are agitated in an excess of detergent solution to clean them.

Typically, the cycles of a wash program include:

1. a wash cycle (in which the drum is filled to a certain level and the articles agitated in the solution, then the solution drained); spinning may be used to aid solution removal;
2. a rinse phase (in which the drum is filled with water to a certain level and the articles agitated in the water, then the water drained); spinning may be used to aid solution removal;
3. a spin cycle, in which the basket is spun rapidly with the drain open such that remaining water, including water absorbed within the fabric of the articles, is removed by centrifugal force.

Stain Release Index

Often referred to as SRI, this is a measure of how much of a stain is removed. An SRI of 100 means complete stain removal.

The SRI values given herein were obtained as follows. The colour of the stains was measured, both before and after washing, on a flatbed scanner and expressed in terms of the difference between the stain and an identical but clean cloth giving ΔE*(before wash) or ΔE*(after wash) values respectively. The ΔE values are the colour differences defined as the Euclidian distance between the stain and clean cloth in L*a*b* colour space. The ΔE*(after wash) values were then be converted to Stain Removal Index values by application of the standard transformation:

$$\text{Stain Removal Index (SRI)} = 100 - \Delta E^{*}(\text{after wash})$$

EXAMPLES

The following examples are provided by way of illustration and are not intended to limit the invention.

The inventors have demonstrated that a power treatment demonstrably improves cleaning as compared to a comparable wash program without a power treatment. Further tests have demonstrated power treatments according to the invention often provide results not dissimilar to those associated with direct product application across a wide range of stains. The inventors have observed enhanced cleaning performance when the power treatment is carried out at elevated temperature (the solution is heated before it is sprayed) and/or with agitation.

The inventors have also found that, advantageous, shorter subsequent wash cycles may be permitted, with comparable or often superior results for power treatment +½ wash as compared to a normal wash cycle. As a consequence, less water and/or energy can be used.

The inventors have observed that these effects are even more pronounced using the compositions as described herein. The inventors have further observed that, while compositions including a coactive as claimed significantly improve the power treatment results, they also provide equivalent performance to comparative formulation without said coactive in normal washes. This both demonstrates that the inclusion of coactive acts synergistically with the power treatment, and shows that, even if no additional detergent is added, the formulations comprising a coactive as claimed are suitable for use in the normal wash step that typically follows the power soak.

The inclusion of a coactive (in this case, CAP-B) was compared to a comparison formulation across a variety of LAS/LES/NI ratios. In each case, the laundry product contained 10 wt % surfactant system (either 10 wt % LAS/LES/NI or 8 wt % LAS/LES/NI+2 wt % CAP-B). In each case, a power treatment was performed as follows to assess the performance.

Products as described were evaluated for their stain removal performance at a usage level of 1.7 g per litre. In advance of the normal wash process one part product was diluted with five parts water then used to power treat the stained monitors and ballast fabric, totalling 40 g per litre, at room temperature. Once the power treatment had been absorbed into the fabric load a holding step of 20 minutes was used, after which all fabric was washed for 30 minutes in water conditioned to 30° C. with no further product addition.

| Surfactant ratio LAS/LES/NI | LARD SRI No co-surfactant | LARD SRI With CAP-B |
|---|---|---|
| 25/75/0 | 65.72 | 67.37 |
| 40/50/10 | 67.15 | 70.32 |
| 70/30/0 | 69.53 | 76.56 |
| 25/35/40 | 65.10 | 70.41 |

Across the formulation space, a significant increase in performance was observed when CAP-B was included.

The results presented below demonstrate that the upturn in performance is associated with the power treatment. Similar cleaning was observed in a normal "in wash" process for both formulations without a coactive and the formulation including CAP-B.

| | Beef fat | Lard | Pottery clay |
|---|---|---|---|
| 40/50/10 In-wash | 65.54 | 70.73 | 68.40 |
| 40/50/10 + CAP-B In-wash | 67.22 | 72.21 | 68.77 |
| 40/50/10 + CAP-B Power Soak | 76.82 | 76.82 | 73.33 |
| 25/35/40 In-wash | 65.45 | 69.96 | 69.67 |
| 25/35/40 + CAP-B In-wash | 65.70 | 70.49 | 69.69 |
| 25/35/40 + CAP-B Power Soak | 75.07 | 73.85 | 73.89 |

The invention claimed is:

1. A method of laundering articles comprising:

combining a detergent composition and water to provide a detergent solution, wherein the detergent composition comprises 10% of a surfactant system containing a betaine;

introducing into a washing machine basket the detergent solution so as to dampen articles in the basket; and waiting for a duration of time during which no water or further detergent solution is added to the basket containing the dampened articles;

wherein the surfactant system comprises a coactive and at least one surfactant;

wherein the coactive is cocamidopropyl betaine (CAP-B) and the other surfactants in the surfactant system comprise linear alkylbenzenesulfonates (LAS) and alkyl ether sulfates (AES) in a ratio of from 1:3 to 7:3 LAS:AES; and wherein the cocamidopropyl betaine accounts for 20 wt % of the surfactant content of the composition.

2. The method of claim 1, wherein the volume of detergent solution is 750 ml or less per kg of articles to be laundered.

3. The method of claim 1, wherein the detergent is a liquid detergent product.

4. The method of claim 1, wherein the method further comprises a washing step after the waiting step, the washing step comprising adding water to a drum and agitating the articles, wherein no detergent is added during the washing step.

5. The method of claim 4 wherein the washing step does not include heating.

6. The method of claim 2, wherein the volume of detergent solution is 500 ml or less per kg of articles to be laundered.

7. The method of claim 6, wherein the volume of detergent solution is 150 ml or less per kg of articles to be laundered.

* * * * *